US009915052B2

(12) United States Patent
Shokouhi

(10) Patent No.: US 9,915,052 B2
(45) Date of Patent: Mar. 13, 2018

(54) MANHOLE COVER ASSEMBLY

(71) Applicant: NEENAH FOUNDRY COMPANY, Neenah, WI (US)

(72) Inventor: Hassan Shokouhi, Neenah, WI (US)

(73) Assignee: Neenah Foundry Company, Neenah, WI (US)

( * ) Notice: Subject to any disclaimer, the term of this patent is extended or adjusted under 35 U.S.C. 154(b) by 6 days.

(21) Appl. No.: 15/267,903

(22) Filed: Sep. 16, 2016

(65) Prior Publication Data

US 2017/0081821 A1 Mar. 23, 2017

Related U.S. Application Data

(60) Provisional application No. 62/219,871, filed on Sep. 17, 2015.

(51) Int. Cl.
*E02D 29/14* (2006.01)

(52) U.S. Cl.
CPC ..... *E02D 29/1427* (2013.01)

(58) Field of Classification Search
CPC ..... E02D 29/14; E02D 29/1436
USPC ..... 404/25; 52/19, 20
See application file for complete search history.

(56) References Cited

U.S. PATENT DOCUMENTS 897,048 A * 8/1908 Armstrong ..... F15B 11/0365 72/453.06
6,199,414 B1 * 3/2001 Chang ..... E02D 29/1427 292/11
6,811,119 B1 11/2004 Petersen et al.
7,243,515 B2 * 7/2007 Meyer ..... E02D 29/1427 404/25
7,712,995 B2 * 5/2010 Stadler ..... E02D 29/1436 404/25
7,891,904 B2 * 2/2011 Stadler ..... E02D 29/1427 404/25
7,896,574 B2 * 3/2011 Nolle ..... E02D 29/14 404/25
8,784,000 B2 * 7/2014 Reynolds ..... E02D 29/1436 404/25
9,340,948 B2 * 5/2016 Allen ..... E02D 29/14

FOREIGN PATENT DOCUMENTS

EP 0 856 611 A1 8/1998

OTHER PUBLICATIONS

Search Report issued in Great Britain application No. GB1615654.9, dated Dec. 15, 2016.

* cited by examiner

*Primary Examiner* — Thomas B Will
*Assistant Examiner* — Katherine J Chu
(74) *Attorney, Agent, or Firm* — Foley & Lardner LLP

(57) ABSTRACT

A manhole cover assembly includes a manhole cover and a latch assembly. The manhole cover is supportable by a seat of a manhole frame. The latch assembly includes a latch housing fixedly coupled to the manhole cover. A latch plunger is slidably coupled to the latch housing. The latch plunger includes a follower arm. A latch lever is rotatably coupled to the latch housing. The latch lever includes a stop. The latch lever is rotatable relative to the latch housing between a locked position and an unlocked position. The stop is structured to engage the manhole frame when the latch lever is rotated to unlocked position so as to force the manhole cover away from the frame.

9 Claims, 6 Drawing Sheets

MANHOLE COVER ASSEMBLY

CROSS REFERENCE TO RELATED APPLICATIONS

The present application claims the benefit of priority to U.S. Provisional Patent Application No. 62/219,871, filed Sep. 17, 2015 and the contents of which are incorporated herein by reference in its entirety

TECHNICAL FIELD

The present disclosure relates generally to the field of manhole and hatch cover assemblies.

BACKGROUND

A manhole provides access to an underground passage or confined area. The underground passage or confined area may contain public utility equipment, such as sewer lines, storm drains, electrical and telecommunication cables, etc. A manhole or hatch cover is a removable plate that forms a lid over the opening of a manhole. Manhole covers are used to prevent individuals and objects from falling into the manhole, as well as to prevent unauthorized access into the manhole. The terms "manhole cover" as used herein to mean either a manhole cover, or a hatch cover, and the like.

Manhole covers are conventionally formed of cast iron, which makes them inexpensive, strong, and heavy, usually weighing more than 100 pounds. The weight helps to keep them in place when traffic passes over them, and makes it difficult for unauthorized individuals to remove them. In addition to being constructed of cast iron, manhole covers may also be constructed of concrete, glass-reinforced plastic or other composite materials, and other materials, or any combination thereof Despite their significant weight, manhole covers can be dislodged in several ways. For example, an explosion within a manhole can cause a sudden pressure buildup that can dislodge the manhole cover. For example, gases (e.g., methane from sewage or natural gas from a leaking natural gas line) can become trapped in the space within the manhole, as well as within the passages or spaces connected to the manhole. The gas may be ignited, for example, due to a spark from a frayed power cable. Some explosions generate sufficient pressure to dislodge the manhole from its frame. However, higher-intensity explosions may propel the manhole cover up to 20 feet or more into the air. A heavy manhole cover flying through the air can be extremely dangerous or deadly. In addition to the human and property damage risk, individuals or objects may subsequently fall into the now-uncovered manhole.

Excessive rainfall and flooding can also dislodge manhole covers. For example, storm drain systems may become overfilled during periods of excessive rainfall. Water may flow through the storm drain systems and up through a manhole. Sufficient pressure from the water may dislodge manhole covers and "float" them away. The now-uncovered manhole can be obscured by dirty water, thereby providing a dangerous risk that an unwary victim may inadvertently fall into the manhole and into the storm drain system.

SUMMARY

Various embodiments relate to manhole cover assemblies. An example manhole cover assembly includes a manhole cover and a latch assembly. The manhole cover is supportable by a seat of a manhole frame. The latch assembly includes a latch housing fixedly coupled to the manhole cover. A latch plunger is slidably coupled to the latch housing. The latch plunger includes a follower arm. A latch lever is rotatably coupled to the latch housing. The latch lever includes a stop. The latch lever is rotatable relative to the latch housing between a locked position and an unlocked position. The stop is structured to engage the manhole frame when the latch lever is rotated to unlocked position so as to force the manhole cover away from the frame.

These and other features, together with the organization and manner of operation thereof, will become apparent from the following detailed description when taken in conjunction with the accompanying drawings, wherein like elements have like numerals throughout the several drawings described below.

BRIEF DESCRIPTION OF THE DRAWINGS

The details of one or more implementations are set forth in the accompanying drawings and the description below. Other features, aspects, and advantages of the disclosure will become apparent from the description, the drawings, and the claims.

It will be recognized that some or all of the figures are schematic representations for purposes of illustration. The figures are provided for the purpose of illustrating one or more implementations with the explicit understanding that they will not be used to limit the scope or the meaning of the claims.

DETAILED DESCRIPTION

Various events, such as explosions or flooding, can cause a sudden pressure increase beneath a manhole cover, which can force the manhole cover from its frame. Several manhole cover assemblies have been developed to release pressure buildup from beneath a manhole cover while limiting displacement of the manhole cover relative to its frame. For example, some manhole cover assemblies include legs or other features to permit limited displacement of the manhole cover. During a pressure-inducing event, the legs contact a bottom surface of the frame, thereby limiting travel of the manhole cover. However, the kinetic energy of the rising manhole cover is concentrated into relatively small areas of the frame surface that are contacted by the legs. Accordingly, significant pressure-inducing events, such as explosions or floods, may damage the frame. This is undesirable because the frame is typically cemented or otherwise permanently fixed in a street or roadway, and removal and replacement of the frame is a significant and costly undertaking.

Figure 1:
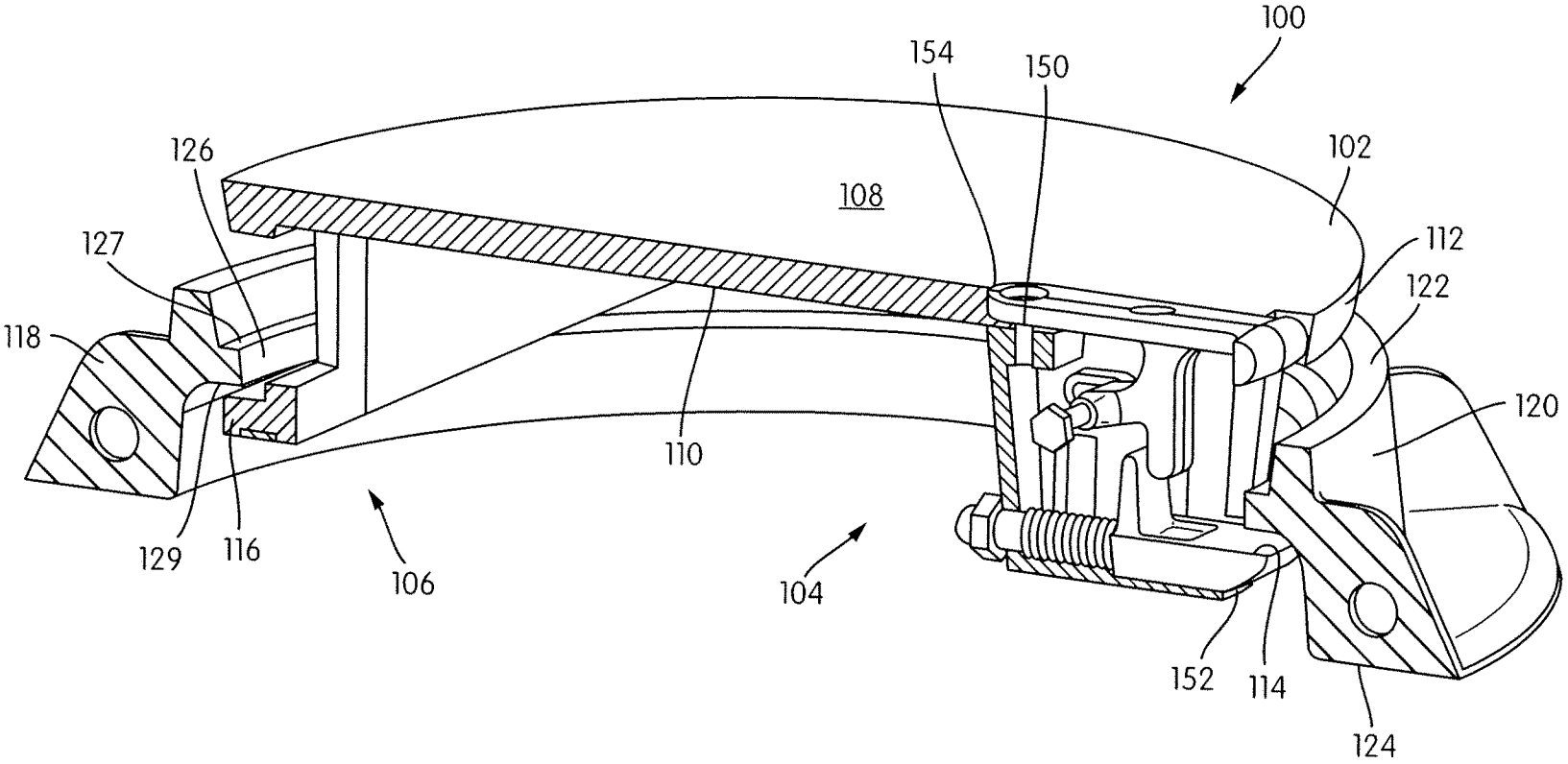
FIG. 1 is a cross-sectional perspective view of a manhole cover assembly, according to an embodiment.

FIG. 1 is a cross-sectional perspective view of a manhole cover assembly 100, according to an embodiment. It should be noted that for clarity and brevity, embodiments are described herein as relating to manhole cover assemblies. However, embodiments described herein may also be utilized in conjunction with hatch covers or other types of covers. As shown in FIG. 1 the manhole cover assembly 100 includes a manhole cover 102, a latch assembly 104, and a lug assembly 106. The manhole cover 102 is generally disc-shaped, having a top surface 108, a bottom surface 110 and an outer periphery 112. The latch assembly 104 and the lug assembly 106 are each securely coupled (e.g., bolted, welded, etc.) to the bottom surface 110 of the manhole cover 102. The latch assembly 104 includes a latch 114 extending radially outward from the latch assembly 104. Similarly, the lug assembly 106 includes a lug 116 extending radially outward from the lug assembly 106.

A frame 118 is configured to support the manhole cover 102 over the opening of a manhole (not shown). The frame 118 is fixedly secured (e.g., cemented or otherwise fixed) within a substrate (e.g., street, road, sidewalk, etc.) defining the opening of the manhole (not shown). The frame 118 is generally ring-shaped, having a peripheral wall 120 extending between an upper surface 122 and an opposite lower surface 124. The peripheral wall 120 has an inner diameter that is slightly larger than an outer diameter of the manhole cover 102. In operation, the upper surface 122 of the frame 118 is generally flush with the road or other surface that defines the manhole.

The frame 118 also includes a projection 126 that extends radially inward from the peripheral wall 120. The projection 126 defines a seat 127 facing longitudinally outward toward the upper surface 122, and defines a catch 129 facing longitudinally inward toward the lower surface 124. The seat 127 is structured to support the manhole cover 102 within the frame 118. More specifically, the bottom surface 110 of the manhole cover 102 proximate the outer periphery 112 rests on, and is supported by, the seat 127 when the manhole cover is in a seated position. The top surface 108 of the manhole cover 102 is generally flush with the upper surface 122 of the frame 118 when the manhole cover 102 is in the seated position. The catch 129 is structured to be engaged by the each of the latch 114 and the lug 116 during a pressure-inducing event so as to retain the manhole cover 102, while controllably dissipating pressure from within the manhole.

Figure 2:
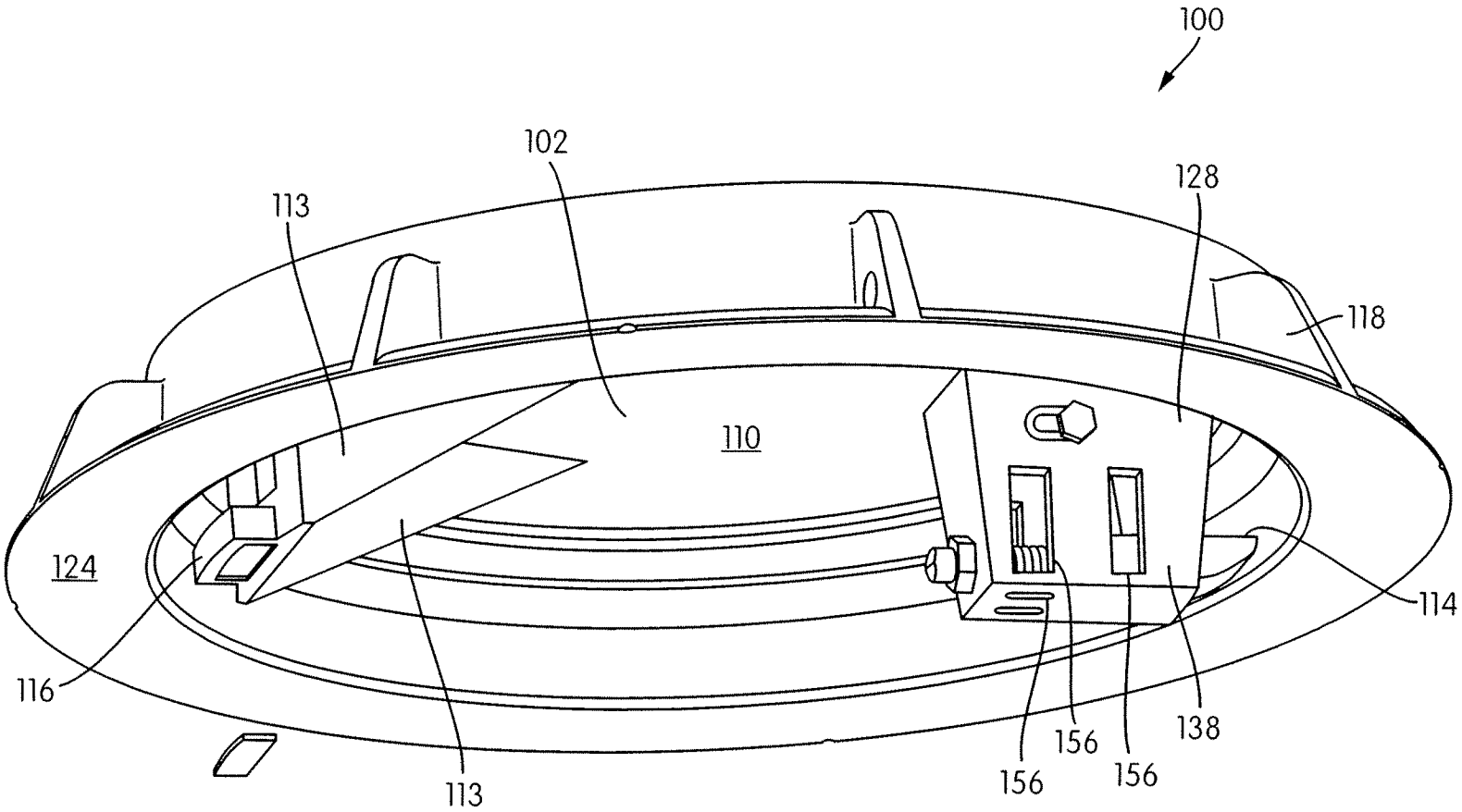
FIG. 2 is a bottom perspective view of the manhole cover assembly of FIG. 1, with the manhole cover in a seated position.

FIG. 2 is a bottom perspective view of the manhole cover assembly 100 of FIG. 1, with the manhole cover 102 in the seated position. As shown in FIG. 2, when the manhole cover 102 is in the seated position, as is typically the case, there is a gap between the lower surface 124 of the frame 118 and each of the latch 114 and the lug 116. A sudden pressure increase against the bottom surface 110 of the manhole cover 102 can cause the manhole cover 102 to move relative to the frame 118 from the seated position (e.g., as shown in FIG. 2) to the unseated position (e.g., as shown in FIG. 1). Returning to FIG. 1, it can be seen that in the unseated position, the latch 114 and the lug 116 each contact the lower surface 124 of the frame 118. Accordingly, the latch and lug assemblies 104, 106 are configured to limit displacement of the manhole cover 102 during a pressure-inducing event in which the manhole cover 102 is forced to the unseated position.

The latch and lug assemblies 104, 106 are also configured to controllably dissipate pressure from within the manhole during a pressure-inducing event. As discussed in further detail below, the latch and lug assemblies 104, 106 permit the energy from a pressure-inducing event (e.g., an explosion or flood) to move the manhole cover 102 from the seated position to the unseated position. When in the unseated position, high-pressure fluid (e.g., air or water) and debris may escape from the manhole through the space then available between the manhole cover 102 and the frame 118, proximate the outer periphery 112 of the manhole cover 102 and the projection 126 of the frame 118. Thus, in response to a pressure-inducing event, the latch and lug assemblies 104, 106 of the manhole cover assembly 100 operate to controllably release pressure from within a manhole rather than allowing the pressure to build up beneath the manhole cover 102 to a potentially dangerous level. In doing so, the latch and lug assemblies 104, 106 prevent the manhole cover 102 from being launched from the frame 118 by a pressure-inducing event, while also preventing damage to the frame 118 and the surface (e.g., street) to which the frame is secured.

The manhole cover assembly 100 also includes extractor rails 113 fixedly coupled (e.g., welded) to each of the manhole cover 102 and the lug assembly 106 so as to form a gradual ramp from the lug 116 to the bottom surface 110 of the manhole cover 102. The extractor rails 113 facilitate easy removal of the manhole cover 102 from the frame 118. In particular, as the manhole cover 102 is pulled away from the frame 118, extractor rails 113 slide against the upper surface 122 of the peripheral wall 120 of the frame 118. Upon the manhole cover 102 being completely removed from the frame 118, a skid pad 115 affixed (e.g., bolted) to a bottom surface 111 of the lug assembly 106 contacts the outer surface (e.g., roadway). The skid pad 115 may be formed of high molecular weight polyethylene (HMWP), Teflon, rubber, or other materials.

As illustrated in FIG. 2 and as discussed further in connection with FIGS. 3-6, the latch assembly 104 includes a latch housing 128. As will be appreciated, the latch housing 128 is structured to support and retain the various components of the latch assembly 104. As illustrated in FIGS. 1 and 2, the latch housing 128 is fixedly coupled (e.g., welded) to the bottom surface 110 of the manhole cover 102.

Figure 3:
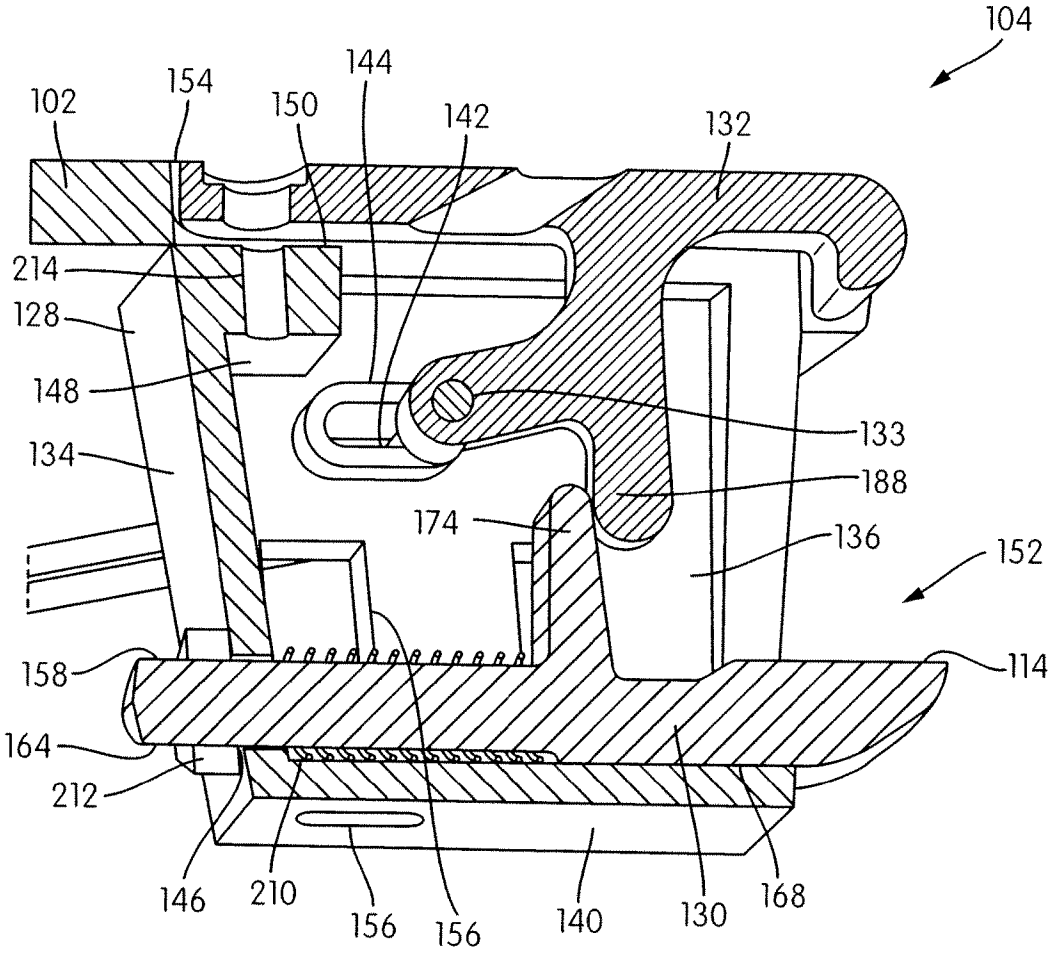
FIG. 3 is a cross-sectional view of the latch assembly of the manhole cover assemblies of FIGS. 1 and 2.

FIG. 3 is a cross-sectional view of the latch assembly 104 of FIGS. 1 and 2. The latch assembly 104 includes the latch housing 128, a latch plunger 130, and a latch lever 132. The latch plunger 130 is disposed within and is slidably coupled to the latch housing 128. The latch plunger 130 defines the latch 114. The latch lever 132 is disposed at least partially within, and is operatively coupled to the latch housing 128 via a latch bolt 133. As will be appreciated, the latch lever 132 may be operated by a user to engage, and thereby actuate, the latch plunger 130.

In one embodiment, as shown in FIGS. 1-3, the latch housing 128 includes an inner wall 134, a first lateral wall 136 (FIG. 3), a second lateral wall 138 (FIG. 2) and a bottom wall 140, which together form the latch housing 128. In one embodiment, the inner wall 134, the first and second lateral walls 136, 138, and the bottom wall 140 are formed of metal (e.g., steel, iron, aluminum, any alloys thereof, etc.) plates or sheet metal, which are welded together to form the latch housing 128. In other embodiments, the inner wall 134, the lateral walls 136, and the bottom wall 140 are formed of cast metal (e.g., steel, iron, aluminum, any alloys thereof, etc.), stamped sheet metal (e.g., steel or aluminum), and injection molded polymer to form the latch housing 128.

As shown in FIG. 3, the first lateral wall 136 defines a slot-shaped opening 142 and a slot-shaped boss 144 extending into the latch housing 128 from the first lateral wall 136. Although not shown, the second lateral wall 138 may also include a corresponding slot-shaped opening 142 and slot-shaped boss 144. The inner wall 134 defines a latch rod opening 146 that extends through the inner wall 134 proximate the bottom wall 140. A ledge 148 extends from the inner wall 136 into the latch housing 128 at an upper-most end of the inner wall 136 adjacent the bottom surface 110 of the manhole cover 102. The ledge 148 is structured to support the latch lever 132 when the latch lever 132 is in a disengaged position, as shown in FIG. 3.

As shown in FIGS. 1 and 3, the latch housing 128 defines a top opening 150 and an outer radial opening 152. The top opening 150 is positioned proximate a corresponding latch opening 154 defined by the manhole cover 102. The latch opening 154 permits access to the latch lever 132, which extends through the top opening 150 of the latch housing 128, so as to enable a user to operate the latch 114. The latch 114 of the latch plunger 130 extends through the outer radial opening 152 to engage the catch 129 so as to retain the manhole cover 102 within the frame 118. In some embodiments, the latch housing 128 includes an outer peripheral wall that defines an opening through which the latch 114 may extend.

As shown in FIGS. 2 and 3, the first and second lateral walls 136, 138 and the bottom wall 140 of the latch housing 128 each define vents 156. According to various embodiments, one or more of the inner wall 134, the first and second lateral walls 136, 138, and the bottom wall 140 may define vents 156. The vents 156 permit fluids (e.g., water) and debris to exit the latch housing 128, should fluids and/or debris enter the latch housing 128, e.g., via the top and/or outer radial openings 150, 152.

Figure 4:
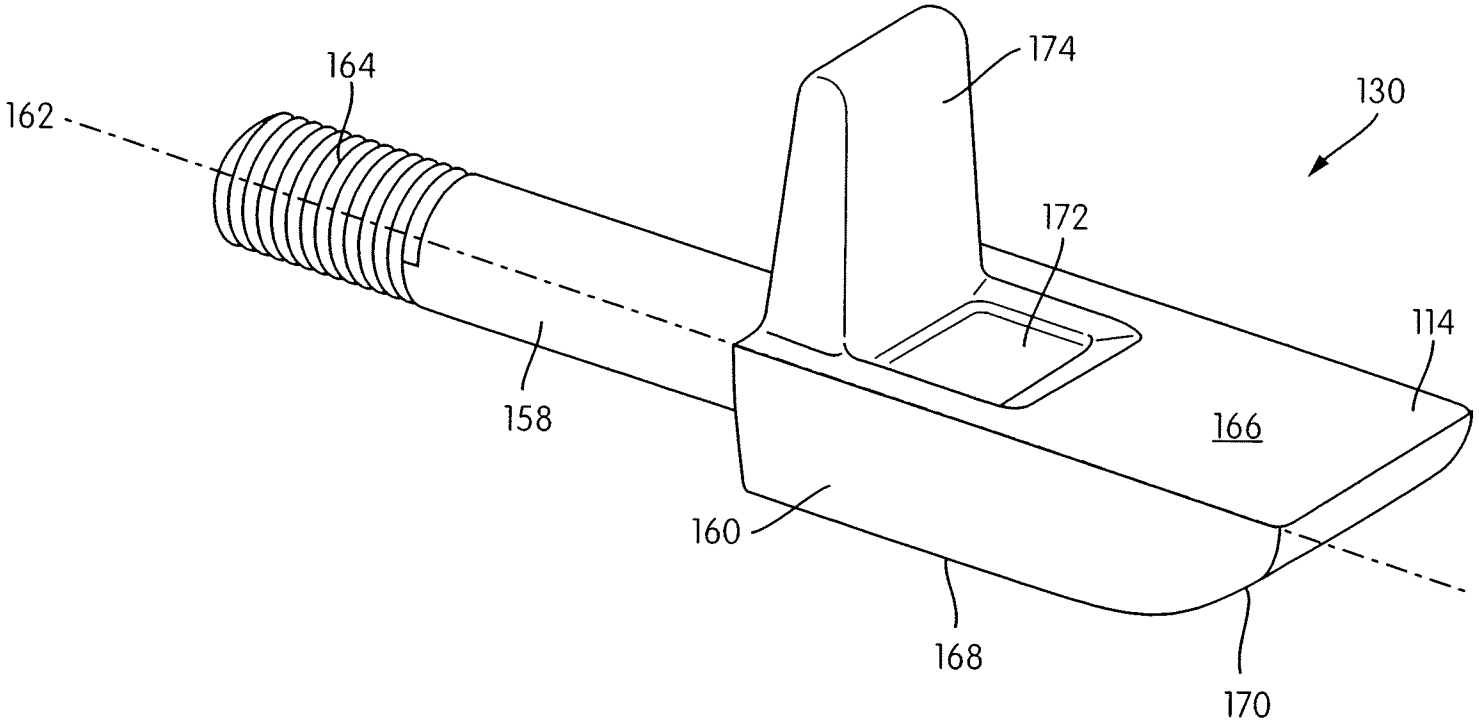
FIG. 4 is a top perspective view of the latch plunger of the latch assembly of FIG. 3.

FIG. 4 is a top perspective view of the latch plunger 130 of FIGS. 1-3. The latch plunger 130 includes a latch rod 158 and a latch member 160 extending from the latch rod 158 along a longitudinal axis 162 of the latch rod 158. The latch rod 158 may include a threaded end 164 opposite the latch member 160. The latch member 160 includes a first face 166 defining a plane parallel to the longitudinal axis 162, and a second face 168 opposite the first face 166. The first face 166 defines the latch 114 and the second face 168 defines a ramp 170, which curves towards the first face 166, extending through the longitudinal axis 162. The latch member 160 defines a pocket 172 extending radially inward from the first face 166 towards the longitudinal axis 162. A follower arm 174 extends radially outward from the first face, adjacent each of the latch rod 158 and the pocket 172.

Figure 5:
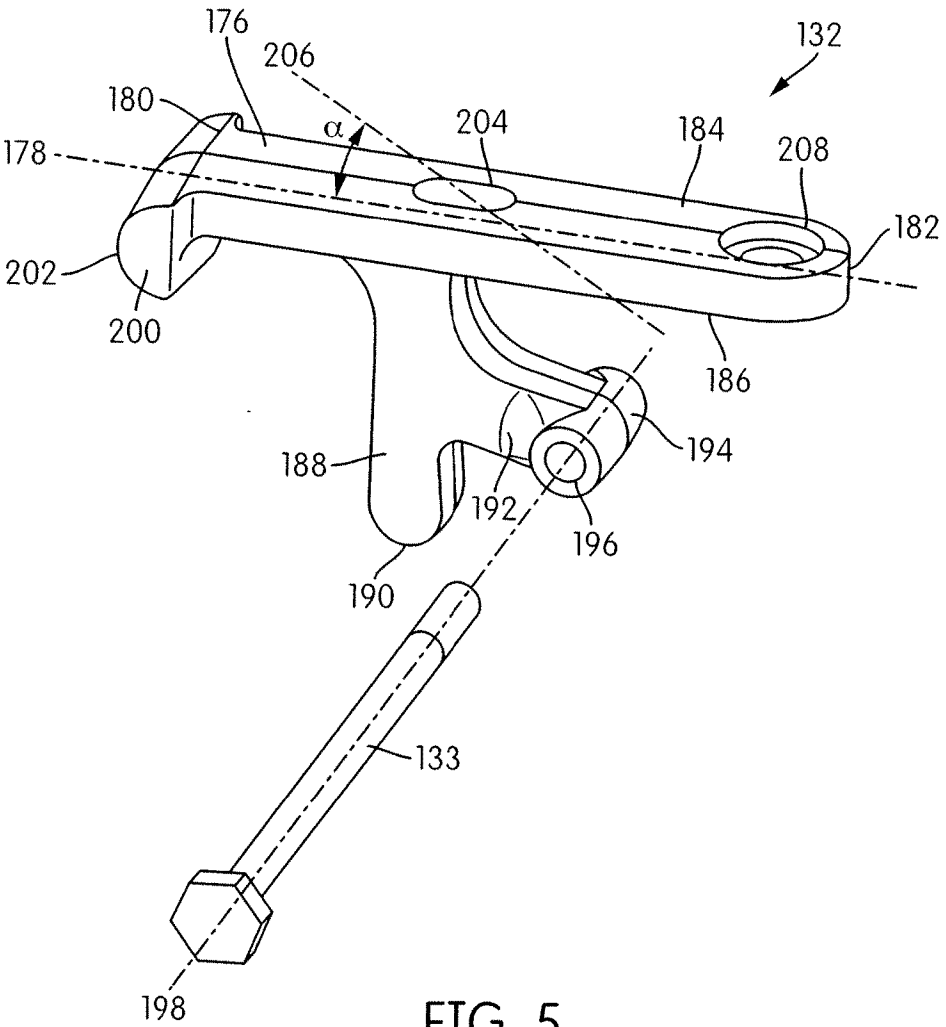
FIG. 5 is a top perspective view of the latch lever of the latch assembly of FIG. 3.

FIG. 5 is a top perspective view of the latch lever 132 of FIGS. 1-4. The latch lever 132 includes an elongate latch lever member 176 that extends generally along a longitudinal axis 178 between a first end 180 and a second end 182, and defining a top surface 184 and an opposite bottom surface 186. An actuating arm 188 extends from the bottom surface 186 generally perpendicular to the longitudinal axis 178, defining an actuating end 190. A pivot arm 192 extends longitudinally outward from the actuating arm between the bottom surface 186 and the actuating end 190. A pivot boss 194 is formed at an end of the pivot arm 192. The pivot boss 194 defines a pivot bore 196 having a pivot axis 198 perpendicular to the longitudinal axis 178. The pivot boss 194 is structured to receive the latch bolt 133 via the pivot bore 196. The pivot boss 194 is structured so as to abut the slot-shaped bosses 144 of each of the first and second lateral walls 136, 138 when the latch lever 132 is installed in the latch housing 128.

The latch lever 132 also defines a stop 200 that extends from the first end 180 of the latch lever member 176. The stop 200 includes an outer extraction surface 202. As discussed further in connection with FIG. 6, the outer extraction surface 202 is structured to contact the seat 127 and the inner surface of the peripheral wall 120 of the frame 118 when the manhole cover 102 is being extracted from the frame 118. As shown in FIG. 5, the outer extraction surface 202 can be rounded or can include other cam-shaped profiles so as to facilitate extraction of the manhole cover 102 from the frame 118.

The latch lever member 176 defines a first bore 204 extending through the latch lever member 176 along a first bore axis 206, from the top surface 145 to the bottom surface 147. The first bore axis 206 is positioned at an angle $\alpha$ relative to the longitudinal axis 178 of the latch lever member 176. In one embodiment, $\alpha$ is 30 degrees. In another embodiment, $\alpha$ is 45 degrees. In various other embodiments, $\alpha$ is any of less than 30 degrees, between 30 and 45 degrees, and between 45 and 90 degrees. As discussed further in connection with FIG. 6, the first bore 204 is structured to receive a lifting tool (not shown), such as a pick or a hook, for example.

The latch lever 132 also defines a second bore 208 extending through the latch lever member 176 proximate the second end 182 along an axis perpendicular to the longitudinal axis 178. As shown in FIG. 5, the second bore 208 may include a counter bore. According to an embodiment, the second bore 208 is structured to receive a retaining bolt (not shown) to securely couple the latch lever member 176 to the manhole cover 102 in a locked position, as discussed further in connection with FIG. 6. According to various embodiments, the retaining bolt may include a pentagonal (5-sided) head or other non-standard bolt head configurations so as to deter unauthorized tampering and vandalism. In other embodiments, the retaining bolt may include a standard hexagonal (6-sided) head or other bolt head configurations.

Turning back to FIG. 3, assembly and operation of the latch assembly 104, including the latch plunger 130 of FIG. 4 and the latch lever 132 of FIG. 5 will now be described. The latch plunger 130 is disposed within the latch housing 128, with the second face 168 of the latch member 160 abutting an interior face of the bottom wall 140 of the latch housing 128. The latch rod 158 extends through the latch rod opening 146 of the inner wall 134 of the latch housing 128. The latch rod 158 extends through a latch spring 210 disposed within the latch housing 128. As shown in FIG. 3, the latch rod 158 is structured such that there is clearance between the latch rod 158 and the bottom wall 140 of the latch housing 128 when latch plunger 130 is installed within the latch housing 128, so as to accommodate the latch spring 210. In operation, the latch spring 210 is compressed between an interior face of the inner wall 134 of the latch housing 128, and the follower arm 174 of the latch plunger 130. A nut 212 (and a washer in some embodiments) is attached to the threaded end 164 of the latch rod 158 extending through the latch housing 128. The nut 212 is tightened so as to move the latch 114 towards an interior of the latch housing 128 and compress the latch spring 210. In other words, tightening the nut 212 moves the latch 114 radially inward and away from the catch 129 of the frame 118 (FIG. 1). In operation, the latch assembly 104 may be adjusted via the nut 212 so as to ensure that operating the latch lever 132 sufficiently moves the latch 114 so as to clear the catch 129.

As discussed briefly in connection with FIG. 5, the latch lever 132 is supported on the ledge 148 when the latch lever 132 is in a disengaged position. The ledge 148 defines a ledge bore 214, which is structured to receive a fastener (not shown) so as to securely couple the latch lever 132 to the latch housing 128, and therefore, to securely couple the latch lever 132 to the manhole cover 102. Upon assembly, the actuating arm 188 of the latch lever 132 abuts the follower arm 174 of the latch plunger 130.

Figure 6:
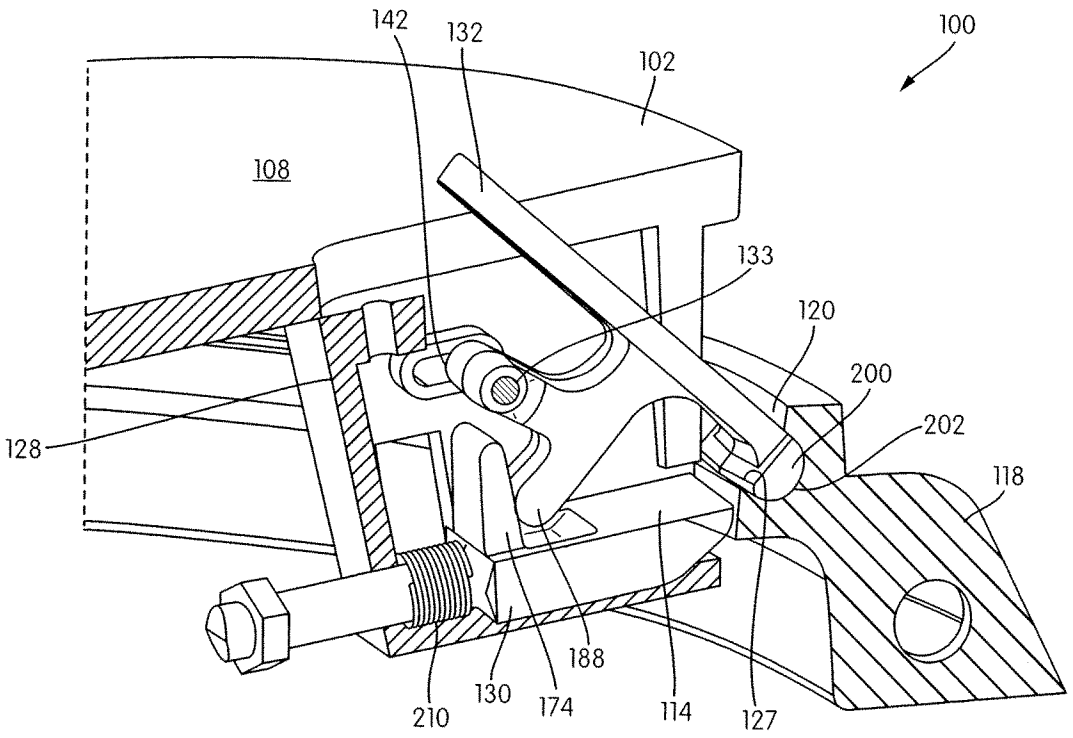
FIG. 6 is a partial cross-sectional view of the manhole cover assemblies of FIGS. 1 and 2.

FIG. 6 is a partial cross-sectional view of the manhole cover assembly 100 of FIGS. 1 and 2, illustrating the manhole cover 102 being removed from the frame 118. As mentioned, a pick or lifting tool (not shown), may be used to rotate the latch lever 132 upwards from the top surface 108 of the manhole cover 102. Upon the latch lever 132 being operated by a user, the latch lever 132 slides relative to the latch housing 128 via the latch bolt 133 sliding within the slot-shaped opening 142 so as to move the latch bolt 133 against the radially outward-most surface of the slot-shaped opening 142. As the latch lever 132 is further engaged, the latch lever 132 pivots about the latch bolt 133 so as to rotate relative to the latch housing 128.

Further rotation of the latch lever 132, while pivoting on the latch bolt 133 results in two actions. First, the actuating arm 188 presses against the follower arm 174, thereby sliding the latch plunger 130 so as to compress the latch spring 210 and move the latch 114 away from the frame 118 and into the latch housing 128. Second, rotation of the latch lever 132 causes the outer extraction surface 202 of the stop 200 to contact the seat 127 and the inner surface of the peripheral wall 120 of the frame 118. As the latch lever 132 is rotated, the contact between the stop 200 and the frame 118 forces the latch bolt 133 upwards and radially outwards against the slot-shaped opening 142. Accordingly, the force exerted on the slot-shaped opening 142 of the latch housing 128 causes the manhole cover 102 to move upward and radially outward from the frame 118. The lever arm created by the latch lever 132 further operates to amplify the input force imparted on the latch lever 132 to produce an even greater output force against the latch housing 128. Thus, the latch assembly 104 facilitates easy removal of the manhole cover 102 from the frame 118 such that a single individual can remove the manhole cover 102 himself or herself.

As the manhole cover 102 is pulled away from the frame 118, the extractor rails 113 (FIG. 1) slide against the upper surface 122 of the peripheral wall 120 of the frame 118. As the manhole cover 102 is completely removed from the frame 118, the skid pad 115 affixed to a bottom surface 111 of the lug assembly 106 contacts the outer surface (e.g., roadway).

While this specification contains many specific implementation details, these should not be construed as limitations on the scope of what may be claimed, but rather as descriptions of features specific to particular implementations. Certain features described in this specification in the context of separate implementations can also be implemented in combination in a single implementation. Conversely, various features described in the context of a single implementation can also be implemented in multiple implementations separately or in any suitable subcombination. Moreover, although features may be described above as acting in certain combinations and even initially claimed as such, one or more features from a claimed combination can in some cases be excised from the combination, and the claimed combination may be directed to a subcombination or variation of a subcombination.

As utilized herein, the term "substantially" and any similar terms are intended to have a broad meaning in harmony with the common and accepted usage by those of ordinary skill in the art to which the subject matter of this disclosure pertains. It should be understood by those of skill in the art who review this disclosure that these terms are intended to allow a description of certain features described and claimed without restricting the scope of these features to the precise numerical ranges provided unless otherwise noted. Accordingly, these terms should be interpreted as indicating that insubstantial or inconsequential modifications or alterations of the subject matter described and claimed are considered to be within the scope of the invention as recited in the appended claims. Additionally, it is noted that limitations in the claims should not be interpreted as constituting "means plus function" limitations under the United States patent laws in the event that the term "means" is not used therein.

The terms "coupled" and the like as used herein mean the joining of two components directly or indirectly to one another. Such joining may be stationary (e.g., permanent) or moveable (e.g., removable or releasable). Such joining may be achieved with the two components or the two components and any additional intermediate components being integrally formed as a single unitary body with one another or with the two components or the two components and any additional intermediate components being attached to one another.

It is important to note that the construction and arrangement of the system shown in the various example implementations is illustrative only and not restrictive in character. All changes and modifications that come within the spirit and/or scope of the described implementations are desired to be protected. It should be understood that some features may not be necessary and implementations lacking the various features may be contemplated as within the scope of the application, the scope being defined by the claims that follow. When the language "at least a portion" and/or "a portion" is used the item can include a portion and/or the entire item unless specifically stated to the contrary.

What is claimed is:

1. A manhole cover assembly, comprising:

a manhole cover supportable by a seat of a manhole frame; and a latch assembly, including:

a latch housing fixedly coupled to the manhole cover, a latch plunger slidably coupled to the latch housing, the latch plunger slidable relative to the latch housing between a locked position and an unlocked position, the latch plunger including a following arm, and a latch lever operable by a user to actuate the latch plunger, the latch lever rotatably coupled to the latch housing, the latch lever including a stop, wherein the latch lever is rotatable relative to the latch housing between a locked position and an unlocked position, and wherein the stop is structured to engage the manhole frame when the latch lever is rotated to the unlocked position so as to force the manhole cover away from the frame.

2. The manhole cover assembly of claim 1, wherein the latch lever further includes an actuating arm, the actuating arm structured to engage the follower arm when the latch lever is rotated from the locked position to the unlocked position so as to slide the latch plunger to the unlocked position.

3. The manhole cover assembly of claim 1, wherein the latch plunger defines a latch, the latch structured to engage the manhole frame when the latch plunger is in the locked position so as to prevent the manhole cover from being removed from the frame, and to disengage the manhole frame when the latch plunger is in the unlocked position so as to enable the manhole cover to be removed from the frame.

4. The manhole cover assembly of claim 1, wherein the manhole cover is movable between a seated position in which the manhole cover is supported on the seat of the manhole frame, and an unseated position in which the manhole cover is displaced relative to the seat of the manhole frame, and wherein, in response to a pressure applied to the manhole cover, the latch assembly is configured to permit limited displacement of the manhole cover relative to the seat of the manhole frame, and to controllably dissipate energy relating to the pressure.

5. The manhole cover assembly of claim 4, wherein in the unseated position, a space is defined between the manhole cover and the manhole frame, the space configured to release fluid from the manhole.

6. The manhole cover assembly of claim 1, further comprising:

a lug assembly coupled to the manhole cover and comprising a lug extending radially outward from the lug assembly, wherein the lug is structured to engage a catch defined by the seat of the manhole frame.

7. The manhole cover assembly of claim 1, wherein the latch housing further comprises an inner wall, the inner wall defining a latch rod opening configured to receive a portion of the latch plunger therein.

8. The manhole cover assembly of claim 7, further comprising a latch spring configured to be compressed between the inner wall and the follower arm.

9. The manhole cover assembly of claim 1, wherein the latch housing further comprises at least one lateral wall defining a slot-shaped opening, and wherein the latch lever is configured to be rotatably and slidingly coupled to the latch housing via the slot-shaped opening.

* * * * *